US007931843B2

(12) United States Patent
Krins et al.

(10) Patent No.: US 7,931,843 B2
(45) Date of Patent: Apr. 26, 2011

(54) PROCESS FOR PRODUCING POLYPHENYLENE SULFIDE FILAMENT YARNS

(75) Inventors: Bastiaan Krins, Emmen (NL); Henricus H. W. Feijen, Velp (NL); Peter Heuzeveldt, Aschaffenburg (DE); Christian Vieth, Wörth/Main (DE); Rudolf Elbert, Groβheubach (DE)

(73) Assignee: Polyester High Performance GmbH, Obernburg (DE)

( * ) Notice: Subject to any disclaimer, the term of this patent is extended or adjusted under 35 U.S.C. 154(b) by 164 days.

(21) Appl. No.: 11/794,885

(22) PCT Filed: Mar. 14, 2006

(86) PCT No.: PCT/EP2006/002338

§ 371 (c)(1),
(2), (4) Date: Apr. 9, 2008

(87) PCT Pub. No.: WO2006/097281

PCT Pub. Date: Sep. 21, 2006

(65) Prior Publication Data

US 2008/0213561 A1 Sep. 4, 2008

(30) Foreign Application Priority Data

Mar. 18, 2005 (EP) ..... 05005914

(51) Int. Cl.
*B29C 47/88* (2006.01)

(52) U.S. Cl. ..... 264/211.15; 264/211.2; 264/235.6

(58) Field of Classification Search ..... 264/235.6, 264/211.15, 211.2
See application file for complete search history.

(56) References Cited

U.S. PATENT DOCUMENTS

| | | | | |
|---|---|---|---|---|
| 4,399,084 | A * | 8/1983 | Sagawa et al. | 264/450 |
| 4,610,916 | A * | 9/1986 | Ballard | 442/189 |
| 4,748,077 | A * | 5/1988 | Skinner et al. | 442/199 |
| 4,769,190 | A * | 9/1988 | Utsumi et al. | 264/466 |
| 4,801,492 | A * | 1/1989 | Skinner et al. | 442/199 |
| 4,808,367 | A * | 2/1989 | Homma et al. | 264/555 |
| 4,943,327 | A * | 7/1990 | Gauthier | 156/62.6 |
| 5,024,797 | A * | 6/1991 | Anderheggen et al. | 264/143 |
| 5,225,270 | A * | 7/1993 | Bhoori et al. | 442/324 |
| 5,246,647 | A * | 9/1993 | Beck et al. | 264/41 |
| 5,370,833 | A * | 12/1994 | Wellenhofer et al. | 264/101 |
| 5,372,760 | A | 12/1994 | Wellenhofer et al. | |
| 5,405,695 | A * | 4/1995 | Akatsu et al. | 428/364 |
| 5,424,125 | A * | 6/1995 | Ballard et al. | 428/364 |
| 5,518,670 | A * | 5/1996 | Budenbender et al. | 264/28 |
| 5,667,890 | A * | 9/1997 | Ballard et al. | 428/364 |
| 5,695,869 | A * | 12/1997 | Auerbach et al. | 428/297.4 |
| 5,785,997 | A * | 7/1998 | Budenbender et al. | 425/71 |
| 5,861,117 | A * | 1/1999 | Rosenbaum | 264/37.1 |
| 6,383,432 | B1 * | 5/2002 | Nakajima et al. | 264/210.7 |
| 6,670,034 | B2 * | 12/2003 | Boyd et al. | 428/370 |
| 6,712,592 | B2 * | 3/2004 | Faulenbach et al. | 425/72.2 |
| 2001/0033037 | A1 * | 10/2001 | Nitschke et al. | 264/40.3 |
| 2005/0269011 | A1 * | 12/2005 | Auerbach et al. | 156/62.6 |
| 2008/0213561 | A1 * | 9/2008 | Krins et al. | 428/222 |

FOREIGN PATENT DOCUMENTS

| | | |
|---|---|---|
| DE | 40 06 397 A1 | 11/1990 |
| JP | A 04-100916 | 4/1992 |
| JP | A 04-370218 | 12/1992 |
| JP | A 10-273825 | 10/1998 |

* cited by examiner

*Primary Examiner* — Joseph S Del Sole
*Assistant Examiner* — David N Brown, II
(74) *Attorney, Agent, or Firm* — Oliff & Berridge, PLC

(57) ABSTRACT

The present invention relates to a process for producing a polyphenylene sulfide multifilament yarn, a polyphenylene sulfide multifilament yarn and the use of a polyphenylene sulfide multifilament yarn. The process for producing a polyphenylene sulfide multifilament yarn is characterized in that only after time period between 0.1 sec and 0.3 sec after leaving the spinneret the filaments of the spun yarn are subjected to an active cooling stage. The Polyphenylene sulfide multifilament yarn having a filament linear density of 5 dtex to 30 dtex, an overall linear density of 500 dtex to 2500 dtex, a breaking tenacity in the range of 50 cN/tex to 80 cN/tex and an elongation at break of 8% to 16% for a yarn with a breaking tenacity in the range of 60 cN/tex to 80 cN/tex and an elongation at break of 16% to 30% for a yarn with a breaking tenacity in the range of 50 cN/tex to 60 cN/tex.

13 Claims, No Drawings

PROCESS FOR PRODUCING POLYPHENYLENE SULFIDE FILAMENT YARNS

BACKGROUND

The present invention relates to a process for producing a polyphenylene sulfide multifilament yarn, a polyphenylene sulfide multifilament yarn and the use of a polyphenylene sulfide multifilament yarn.

The term "filament" as used herein means fibers of practically endless length. Yarns consisting of a number of filaments are therefore called filament yarns.

Polyphenylene sulfide filaments are available as monofilament yarns, multifilament yarns or staple fibers. Polyphenylene sulfide filaments are produced by a melt spinning process. They may be used at temperatures up to 190° C. without showing significant damage or degradation. PPS filaments are flame resistant, self-extinguishing and melt at temperatures of about 285° C.

DE 40 06 397 pertains to a process for production of mono- and multifilaments as well as staple fibers made of polyphenylene sulfide. The process is a melt spun process. Below the spinneret air or inert gas with a temperature between 50° C. and 150° C. is blown against the filaments followed by multiple stage drawing to a total draw ratio of 3.7 to 11.2. The process may yield a multifilament yarn with a tenacity of 76 cN/tex and elongation at break of 16%

Japanese Patent Application No. 3-168750 discloses a method for manufacturing polyphenylene sulfide fibers in a melt spun process. Polyphenylene sulfide is melted and spun through a spinneret whereupon the spun yarn is cooled by blowing a cooling air flow with a temperature of at least 45° C. onto same. The yarn is then hot drawn by passing through a heating zone.

Japanese Patent Application No. 9-78693 discloses polyphenylene sulfide fibers for electrical insulation, method of manufacturing the same, and electrical insulation material. The tenacity of the melt spun and drawn fibers lies at 44 cN/tex, elongation at break lies around 20%. Polyphenylene sulfide is spun by a spinneret, the spun thread is passed through a high temperature atmosphere surrounded by a heating tube of 5 cm to 30 cm length at a temperature between 280° C. and 350° C., after which it is solidified by cooling uniformly by air at 100° C. or less, preferably 20-80° C. This undrawn yarn is fed continuously to the heat drawing process and normally is drawn in a plurality of stages of 2 stages or more, without being wound off. The draw ratio should be 3.0-5.5.

Japanese Patent Application No. 2-219475 discloses polyphenylene sulfide fibers and method of manufacturing same. The polyphenylene sulfide fibers consisting of a continuous filament having a tenacity of at least 44 cN/tex and elongation at break of at least 20%. For the process pellets of polyphenylene sulfide fiber polymer are melted at a temperature of 310-340° C. and passed successively through a filter and spinneret holes of 0.1-0.5 mm diameter to form a spun thread strand, which is subsequently passed through a high-temperature atmosphere enclosed by a heat insulating tube or a heating tube disposed over a distance of 5-30 cm immediately below the spinneret in which said spinneret holes are formed and controlled to an ambient temperature of 150-350° C., and then cooled by a warm air flow or cool air flow at 100° C. or below.

SUMMARY

It is an object of the present invention to provide another process for the production of polyphenylene sulfide multifilament yarns in which the cooling is further improved to yield a polyphenylene sulfide multifilament yarn with desired properties regarding breaking tenacity and elongation at break. It is another object of the invention to provide a polyphenylene sulfide multifilament yarn with desired properties regarding breaking tenacity and elongation at break.

DETAILED DESCRIPTION OF EMBODIMENTS

This object is achieved by a process for producing a polyphenylene sulfide multifilament yarn comprising the steps in which a melt of polyphenylene sulfide is fed to a spinning device, the melt is extruded through a spinneret with a plurality of spinneret holes to form a filament bundle with a plurality of filaments, cooling the filament bundle in a cooling zone and winding the filaments after solidifying, characterized in that only after a time period between 0.1 sec and 0.3 sec after leaving the spinneret the filaments of the spun yarn are subjected to an active cooling stage. In a preferred embodiment of the process the temperature of the filaments after leaving the spinneret and before active cooling is at least $T_{spin}-150°$ C. preferably at least $T_{spin}-50°$ C. The maximum temperature of the filaments is $T_{spin}$. $T_{spin}$ means the spinning temperature in ° C. for the polyphenylene sulfide melt. After leaving the spinneret the spun yarn is thus not subjected to an active cooling stage for 0.1 sec to 0.3 sec.

The process according to the invention comprises the steps in which a melt of polyphenylene sulfide is fed to a spinning device, the melt is extruded through a spinneret with a plurality of spinneret holes to form a filament bundle with a plurality of filaments, cooling the filament bundle in a cooling zone and winding the filaments after solidifying.

The cooling behavior of polyphenylene sulfide is certainly complicated and dependent upon a series of parameters. The cooling process also leads to differences in the crystallization behavior of the filaments. The cooling thus determines the crystallization of the polymers in the filament to a large degree, which is noticeable in the later usage of the filaments, for example in drawing.

The viscosity of the polyphenylene sulfide polymer chips used as raw material for the process according to the invention lies between 150 and 300 Pas measured according to ISO/FDIS 11443 (December 2004) at a temperature of 310° C. and a shear rate of 1200 $s^{-1}$.

The polymer used in the process according to the invention essentially has a linear structure, i.e. the level of trifunctional monomers used is lower than 0.1%. The polymer is of course an uncrosslinked polymer as it could otherwise not be used in a melt spinning process. The polymer consists of at least 90% by weight of uncrosslinked linear polyphenylene sulfide.

In the process according to the invention, the length of this stage where the spun yarn is not subjected to active cooling is determined by the speed of the yarn and the time it is not subjected to active cooling. The speed of the yarn is calculated as the winding speed of the first godet in the process. The winding speed of the first godet, i.e. the speed the yarn is drawn off the spinneret, lies preferably in the range of 200 m/min to 1000 m/min. Thus, for example, with a winding speed of the first godet of 300 m/min and a time period before active cooling of approx. 0.15 sec the length of the stage where the spun yarn is not subjected to active cooling is approx. 75 cm.

In a preferred embodiment of the process of the invention, drawing off the yarn is performed at a speed in the range of 250 m/min to 500 m/min.

There is in principle no restriction on the number of individual threads or filaments comprising a multifilament yarn.

A multifilament generally comprises between 10 and 500 filaments, and frequently between 50 and 300 filaments. The multifilaments are usually collected in the course of the process into so-called filament bundles and are wound up in this form. The linear density of the filaments comprising the continuous yarns, i.e. the filament linear density, can also vary within wide limits. In general, however, filament linear densities in the range of approx. 1 to approx. 30 dtex, and preferably between 5 and 30 dtex, more preferably between 5 and 20 dtex, most preferably between 5 and 10 dtex are used. The filament linear density refers to the final yarn which might have been subjected to drawing.

Between the spinneret and the beginning of the first active cooling zone the filament bundle may be passed through a perforated or porous tube for a time period between 0.1 sec and 0.3 sec. While being passed through a perforated or porous tube the temperature of the yarn is at least $T_{spin}$−150° C. preferably at least $T_{spin}$−50° C. Such perforated or porous tubes are also known to those skilled in the art under the term self suction tubes. They make it possible to pull gaseous medium through the filament bundle in such a way that intermingling can be mostly avoided. The filament bundle may also be led between perforated or porous panels. The filament bundle is led through or between perforated or porous tubes or panels in such a way that a gaseous medium reaches the filaments by self-suction. The filament bundle thus pulls the gaseous cooling medium in its proximity, such as the ambient air, so that the gaseous medium flows mostly parallel to the direction in which the filament bundle is moving.

In another preferred embodiment there is between the spinneret and the beginning of the first active cooling zone a so-called heated tube with a temperature between $T_{spin}$−50° C. and $T_{spin}$+10° C. As described the yarn runs through that heated tube for a time period between 0.1 sec and 0.3 sec. Depending upon the type of filament, the length of this element, which is known to those skilled in the art, is determined by the speed of the yarn to be fed through it. However, the length of this element is at least 40 cm.

In a more preferred embodiment of the process according to the invention there is, between the spinneret and the beginning of the first active cooling zone, a heated tube with a temperature between $T_{spin}$−50° C. and $T_{spin}$+10° C. and subsequently a perforated or porous tube or perforated or porous panels. The yarn runs through the combination of a heated tube and a perforated or porous tube or panel for a time period between 0.1 sec and 0.3 sec.

In one embodiment of the active cooling zone of the process according to the invention a gaseous cooling medium is blown into the filament bundle. The flow of the gaseous cooling medium is directed in such a way that it reaches the filaments from one side or circumferentially. The filament bundle is thus being blown on with a gaseous cooling medium in the cooling zone in such a way that the gaseous cooling medium flows through the filament bundle transversely. The gaseous cooling medium may also be blown into the upper section of the cooling zone so that there is a downward flow of cooling medium parallel to the filaments. The temperature of the gaseous cooling medium is preferably 20-100° C. Cooling medium is preferably air.

After passing through a perforated tube, a heated tube with a temperature between $T_{spin}$−50° C. and $T_{spin}$+10° C. or a combination of a heated tube and a perforated tube for a time period between 0.1 sec and 0.3 sec the filaments are preferably cooled in another embodiment of the active cooling zone by a fluid, consisting wholly or partly of a component that is liquid at room temperature the filaments.

The fluid used for cooling in the cooling zone consists wholly or partly of a component that is liquid at room temperature such as water, water vapour, alcohol or mixtures of these components with gaseous media, e.g. air or nitrogen. The cooling zone can be implemented in various embodiments in the method of the invention. In a preferred embodiment, the continuous yarns are cooled while being fed through the cooling zone essentially by a fluid consisting partly or entirely of water.

In a simple and advantageous embodiment of the method of the invention, the continuous yarns are cooled essentially by a water-bath while being fed through the cooling zone. Care must be taken here that the water temperature is not too high, to avoid adhesion between the filaments.

The most preferred embodiment, however, is one in which the polyphenylene sulfide multifilament yarn is cooled, on passing through the cooling zone, essentially by a spray mist of small water droplets. This embodiment exploits the fact that small water droplets, preferably with average diameter not exceeding 150 μm, can dissipate a significantly greater amount of heat than is possible by passage through a water-bath. The reason for this is the additional heat of vaporisation of the droplets, the necessary heat energy being extracted from the yarns. The droplets are advantageously brought into contact with the continuous yarns through nozzles. In this case the cooling zone can take the form of, for example, a mist chamber with nozzles attached at its lower end, which direct the spray mist onto the yarns in the direction opposite to that of the yarn movement and at an angle of, e.g. 45°.

After spinning the filaments of the polyphenylene sulfide multifilament yarn through a spinneret with a plurality of holes, drawing off the yarn filaments at a speed in the range of 200 m/min to 1000 m/min, subjecting the yarn filaments to a temperature of at least $T_{spin}$−150° C. preferably at least $T_{spin}$−50° C. for a time period between 0.1 sec and 0.3 sec, cooling the filaments of the yarn, the filaments may be dried, in preparation for the drawing process, by a method known per se, e.g. by the application of air, for example compressed air at ambient temperature, by means of a blower. Drawing of the yarn filaments in a form known per se may be carried out after the cooling. A drawing ratio from 3 to 6 may be achieved in a single or multiple stage drawing.

In a preferred embodiment of the process according to the invention drawing is carried out after cooling in a first and second drawing step with the yarn tension and/or temperature being constant in the first drawing step and with the yarn tension being increased in the second step. The drawing in a first and second step is preferably being carried out on godets surrounded by ambient air. The yarn tension and/or the temperature is being increased in the second step. In the first drawing step a steam nozzle is preferably present. It is believed that the advantages of drawing the yarn filaments in a first and second drawing step with the yarn tension and/or temperature being constant in the first drawing step and with the yarn tension and/or temperature being increased in the second step may also be applied to other melt spinning processes.

In a more preferred embodiment of the process of the invention drawing in a first and second step is carried out in such a way that the yarn tension in the second drawing step is increased from a start value to an end value by means of a plurality of draw godets, by increasing the speed of successive draw godets. Counted from the start value of the yarn tension to the attainment of the end value, more than two consecutive draw godets, and especially preferably more than three and, for example, more than five godets are used. An overall amount of up to 30 draw godets may be used for the process.

It has surprisingly been found that in such an embodiment the fluff index of the filament can be considerably reduced.

In the process according to the invention, the temperature in the second drawing step can also be increased from a start value to an end value by heating consecutive draw godets to successively higher temperatures that increase from a start value to an end value, it being immaterial for the above-mentioned lowering of the fluff index whether two or more than two consecutive draw godets, counted from the start value of the temperature to the end value, are used.

In a most preferred embodiment drawing in the second drawing step is carried out in such a way that the yarn tension is increased from a start value to an end value by means of a plurality of draw godets, by increasing the speed of successive draw godets and the temperature is increased from a start value to an end value by heating consecutive draw godets to successively higher temperatures that increase from a start value to an end value.

Drawing can optionally be followed by a relaxation step on one or more relax godets.

After drawing in a first and second drawing step winding up of the yarn is carried out at a speed in the range of 1000 m/min to 4000 m/min.

The invention also pertains polyphenylene sulfide multifilament yarns obtainable by a process according to the invention. Said polyphenylene sulfide multifilament yarns exhibit a breaking tenacity of at least 50 cN/tex, preferably 55 cN/tex. In another preferred embodiment the breaking tenacity of the polyphenylene sulfide multifilament yarn is at least 60 cN/tex. In a more preferred embodiment the breaking tenacity of the PPS filament yarn is at least 65 cN/tex. In a most preferred embodiment the breaking tenacity of the PPS filament yarn is at least 70 cN/tex. The breaking tenacity of the polyphenylene sulfide multifilament yarns obtainable by a process according to the invention should not exceed 80 cN/tex.

Elongation at break of the polyphenylene sulfide multifilament yarn obtainable by a process according to the invention lies between 8% and 16% for yarns exhibiting a breaking tenacity of 60 cN/tex to 80 cN/tex, preferably between 10.5% and 12.5%. For polyphenylene sulfide multifilament yarns obtainable by a process according to the invention with a breaking tenacity between 50 cN/tex and 60 cN/tex, elongation at break is preferably in the range of 16% to 30%.

The invention further pertains polyphenylene sulfide multifilament yarns. The linear density of the filaments comprising the continuous yarns, i.e. the filament linear density, can also vary within wide limits. In general, however, filament linear densities in the range of approx. 5 to 30 dtex, preferably 5 to 20 dtex, most preferably 5 to 10 dtex are used.

The polyphenylene sulfide polymer used for the multifilament yarn according to the invention essentially has a linear structure, i.e. the level of trifunctional monomers used is lower than 0.1%. The polymer is of course an uncrosslinked polymer as it could otherwise not be molten and used in a melt spinning process. The polymer consists of at least 90% by weight of uncrosslinked linear polyphenylene sulfide. The preferred polyphenylene sulfide (PPS) generally contains at least 50 mol % and in particular at least 70 mol % of phenylene sulfide units, and is known, for example, under the name of Fortron®.

The polyphenylene sulfide multifilament yarns exhibit a breaking tenacity of at least 50 cN/tex, preferably 55 cN/tex. In another preferred embodiment the breaking tenacity of the polyphenylene sulfide multifilament yarn is at least 60 cN/tex. In a more preferred embodiment the breaking tenacity of the PPS filament yarn is at least 65 cN/tex. In a most preferred embodiment the breaking tenacity of the PPS filament yarn is at least 70 cN/tex. The breaking tenacity of the polyphenylene sulfide multifilament yarns according to the invention usually does not exceed 80 cN/tex.

The polyphenylene sulfide multifilament yarn according to the invention exhibits a filament linear density of 5 dtex to 30 dtex, an overall linear density of 500 dtex to 2500 dtex, a breaking tenacity in the range of 50 cN/tex to 80 cN/tex and an elongation at break of 8% to 16% for a yarn with a breaking tenacity in the range of 60 cN/tex to 80 cN/tex and an elongation at break of 16% to 30% for a yarn with a breaking tenacity in the range of 50 cN/tex to 60 cN/tex As a result of the high elongation at break of 8% to 16% for a yarn with a breaking tenacity in the range of 60 cN/tex to 80 cN/tex and an elongation at break of 16% to 30% for a yarn with a breaking tenacity in the range of 50 cN/tex to 60 cN/tex, the polyphenylene sulfide multifilament yarn according to the invention has a high energy absorption capacity, which, combined with a filament linear density of 5 dtex to 30 dtex, an overall linear density of 500 dtex to 2500 dtex opens up attractive possibilities for use as described below, in fields of application where such a combination of properties is important.

In another preferred embodiment of the polyphenylene sulfide multifilament yarn according to the invention, the yarn has, for a spun length of 10 000 m, a fluff index of less than 2500, and preferably less than 1000, more preferably less than 500.

In yet another preferred embodiment of the polyphenylene sulfide multifilament yarn according to the invention the filaments of the yarn have a linear density of 5 dtex to 20 dtex.

The breaking tenacity of the polyphenylene sulfide multifilament yarn according to the invention lies preferably in the range of 50 cN/tex to 60 cN/tex.

The polyphenylene sulfide multifilament yarn according to the invention may be obtained by the process for producing a polyphenylene sulfide multifilament yarn according to the invention The advantageous combination of properties in the polyphenylene sulfide multifilament yarn according to the invention and in the polyphenylene sulfide multifilament yarn resulting from a process according to the invention makes the use of this multifilament attractive in application fields where high values of filament and overall linear density, breaking tenacity, and elongation at break, coupled with high thermal and chemical stability, are important, as for example for production of needle bonded fabrics, backing fabrics, particularly for use in filter media, for aircraft interior fittings, or as hose reinforcement.

If the polyphenylene sulfide multifilament yarns obtainable by a process according to the invention or the polyphenylene sulfide multifilament yarns according to the invention are used for filter media or needle bonded fabrics a linear density from 900 dtex to 1400 dtex is preferred. In a more preferred embodiment the polyphenylene sulfide multifilament yarn has a linear density from 1000 dtex to 1200 dtex.

For the purposes of the present invention, the filament linear density, breaking tenacity and elongation at break is determined in accordance with ASTM D805. These parameters have to be determined as mean value of at least 5 individual measurements. The fluff index is determined with the FRAYTEC5 from Enka Tecnica.

The present invention is described in more detail in the following non-limiting examples.

EXAMPLES

Example 1

Linear polyphenylene sulfide (Fortron®0320C0) is molten and fed to a spinneret with 200 holes. The holes are circular and have a diameter of 300 μm. The spun multifilament is drawn off at a speed of 300 m/min, passed through a heated tube of app. 12 cm length with a temperature in the heated tube of 300° C. to 320° C. and a perforated tube of app. 100 cm length, passed then through an active cooling zone in which the filaments are cooled by a spray mist of small water droplets, drawn in first and second drawing steps, and subsequently the yarn tension is relaxed by 0.7% in a relaxation step before the multifilament is wound up at a speed of 1350 m/min.

In the first drawing step, drawing is performed with a draw ratio of 4.02. Draw godets 1-4 are used for this purpose, godet 1 having a temperature of 70° C., godets 2 and 3 being unheated, and godet 4 having a temperature of 125° C.

In the second drawing step, drawing is performed with a draw ratio of 1.12 so that the total draw ratio amounts to 4.50. Draw godets 5-20 are used for this purpose, their temperatures and speeds being shown in Table 1. Table 1 shows that in the second drawing zone the filament tension is increased from its start value at godet 5 to its end value at godet 10 by means of six consecutive godets.

TABLE 1

| Draw godet (n) | Speed [m/min] | Temperature [° C.] |
|---|---|---|
| 5 | 1205 | 125 |
| 6 | 1234 | 125 |
| 7 | 1263 | 170 |
| 8 | 1292 | 200 |
| 9 | 1321 | 240 |
| 10-13 | 1350 | 240 |
| 14-20 | 1350 | 240 |

Example 2

Example 2 was carried out in the same way as Example 1, except that in the second drawing zone the yarn tension and temperature were increased as shown in Table 2. Table 2 shows that in the second drawing zone the yarn tension is increased from its start value at godet 6 to its end value at godet 7 by means of two consecutive godets.

TABLE 2

| Draw godet (n) | Speed [m/min] | Temperature [° C.] |
|---|---|---|
| 5 | 1205 | 125 |
| 6 | 1205 | 125 |
| 7 | 1350 | 170 |
| 8 | 1350 | 200 |
| 9 | 1350 | 240 |
| 10-13 | 1350 | 240 |
| 14-20 | 1350 | 240 |

Example 3

Example 3 was carried out in the same way as Example 1, except that in the second drawing zone the yarn tension and temperature were increased as shown in Table 3. Table 3 shows that in the second drawing zone the yarn tension is increased from its start value at godet 6 to its end value at godet 7 by means of two consecutive godets.

TABLE 3

| Draw godet (n) | Speed [m/min] | Temperature [° C.] |
|---|---|---|
| 5 | 1205 | 125 |
| 6 | 1205 | 125 |
| 7 | 1350 | 240 |
| 8 | 1350 | 240 |
| 9 | 1350 | 240 |
| 10-13 | 1350 | 240 |
| 14-20 | 1350 | 240 |

Example 4

Example 4 was carried out in the same way as Example 1, except that in the second drawing zone the yarn tension and temperature were increased as shown in Table 4. Table 4 shows that in the second drawing zone the yarn tension is increased from its start value at godet 5 to its end value at godet 10 by means of six consecutive godets.

TABLE 4

| Draw godet (n) | Speed [m/min] | Temperature [° C.] |
|---|---|---|
| 5 | 1205 | 125 |
| 6 | 1234 | 125 |
| 7 | 1263 | 240 |
| 8 | 1292 | 240 |
| 9 | 1321 | 240 |
| 10-13 | 1350 | 240 |
| 14-20 | 1350 | 240 |

Example 5

Table 5 shows the properties of the polyphenylene sulfide multifilament yarn resulting from Examples 1 to 4. Table 5 shows that the embodiments of the process according to the invention in Examples 1 to 4 result in a polyphenylene sulfide multifilament yarn according to the invention having a filament linear density of 5 dtex to 30 dtex, an overall linear density of 500 dtex to 2500 dtex, a breaking tenacity in the range of 50 cN/tex to 80 cN/tex and an elongation at break of 16% to 30% for a yarn with a breaking tenacity in the range of 50 cN/tex to 60 cN/tex. Comparison of Examples 1 and 4 with Examples 2 and 3 indicates that if the yarn tension is increased in the second drawing zone from its start value at godet 5 to its end value at godet 10 by means of six consecutive godets, a considerably lower fluff index results than if the yarn tension is increased in the second drawing zone from its start value at godet 6 to its end value at godet 7 by means of two consecutive godets.

TABLE 5

| | Example 1 | Example 2 | Example 3 | Example 4 |
|---|---|---|---|---|
| Filament linear density [dtex] | 5.39 | 5.24 | 5.32 | 5.32 |
| Overall linear density [dtex] | 1077 | 1047 | 1063 | 1063 |
| Breaking tenacity [cN/tex] | 57.7 | 54.5 | 57.1 | 57.2 |

TABLE 5-continued

| | Example 1 | Example 2 | Example 3 | Example 4 |
|---|---|---|---|---|
| Elongation at break [%] | 17.5 | 18.0 | 17.9 | 17.3 |
| Hot-air shrinkage [%] | 12.3 | 11.1 | 11.1 | 12.2 |
| Elongation for load of 45 N [%] | 11.9 | 13.5 | 12.6 | 11.8 |
| Modulus at 0.5-2% elongation [cN/tex] | 447 | 412 | 433 | 461 |
| Fluff index [10000 $m^{-1}$] | 409 | 2000 | 1818 | 291 |

The invention claimed is:

1. A process for producing a polyphenylene sulfide multifilament yarn comprising:

feeding a melt of polyphenylene sulfide to a spinning device;

extruding the melt through a spinneret with a plurality of spinneret holes to form a filament bundle with a plurality of filaments;

subjecting the filament bundle to a passive cooling stage, which includes passing the filament bundle through a perforated or porous tube or passing the filament bundle between perforated or porous panels for a time period of between 0.1 s to 0.3 s after the filament bundle leaves the spinneret;

subjecting the filament bundle to an active cooling stage;

drawing the filament bundle after subjecting the filament bundle to the passive cooling stage and the active cooling stage; and winding the filaments after solidifying and the drawing.

2. The process for producing a polyphenylene sulfide multifilament yarn according to claim 1, wherein for a time period between 0.1 s to 0.3 s after leaving the spinneret and before active cooling, the temperature of the filaments is at least $T_{spin}$−150° C.

3. The process for producing a polyphenylene sulfide multifilament yarn according to claim 1, wherein in the active cooling stage a gaseous cooling medium is blown into the filament bundle.

4. The process for producing a polyphenylene sulfide multifilament yarn according to claim 1, wherein in the active cooling stage the filaments are cooled by a fluid, comprising wholly or partly of a component that is liquid at room temperature.

5. The process for producing a polyphenylene sulfide multifilament yarn according to claim 1, wherein drawing is carried out after cooling in a first and second drawing step with the yarn tension and/or temperature being increased in the second step.

6. The process for producing a polyphenylene sulfide multifilament yarn according to claim 5, wherein the yarn tension is increased from a start value to an end value in the second drawing step by means of a plurality of draw godets, whereby more than two consecutive draw godets, counted from the start value to the attainment of the end value, are used.

7. The process for producing a polyphenylene sulfide multifilament yarn according to claim 5, wherein three to 30 consecutive draw rolls are used.

8. The process for producing a polyphenylene sulfide multifilament yarn according to claim 1, wherein winding up of the yarn after drawing is performed at a speed in the range of 1000 m/min to 4000 m/min.

9. The process for producing a polyphenylene sulfide multifilament yarn according to claim 1, wherein the polyphenylene sulfide is a linear polyphenylene sulfide.

10. A process for producing a polyphenylene sulfide multifilament yarn comprising:

feeding a melt of polyphenylene sulfide to a spinning device;

extruding the melt through a spinneret with a plurality of spinneret holes to form a filament bundle with a plurality of filaments;

subjecting the filament bundle to a passive cooling stage, which includes passing the filament bundle through a heated tube with a temperature of at least $T_{spin}$−150° C. for a time period between 0.1 s to 0.3 s;

subjecting the filament bundle to an active cooling stage;

drawing the filament bundle after subjecting the filament bundle to the passive cooling stage and the active cooling stage; and winding the filaments after solidifying and the drawing.

11. The process for producing a polyphenylene sulfide multifilament yarn according to claim 10, wherein for a time period between 0.1 sec and 0.3 sec after leaving the spinneret and before active cooling, the temperature of the filaments is between $T_{spin}$−50° C. and $T_{spin}$+10° C.

12. A process for producing a polyphenylene sulfide multifilament yarn comprising:

feeding a melt of polyphenylene sulfide to a spinning device;

extruding the melt through a spinneret with a plurality of spinneret holes to form a filament bundle with a plurality of filaments;

subjecting the filament bundle to a passive cooling stage, which includes passing the filament bundle through a heated tube with a temperature at least $T_{spin}$−150° C. and subsequently passing the filament bundle through a perforated or porous tube for a time period of between 0.1 s to 0.3 s after the filament bundle leaves the spinneret;

subjecting the filament bundle to an active cooling stage;

drawing the filament bundle after subjecting the filament bundle to the passive cooling stage and the active cooling stage; and winding the filaments after solidifying and the drawing.

13. The process for producing a polyphenylene sulfide multifilament yarn according to claim 12, wherein for a time period between 0.1 s to 0.3 s after leaving the spinneret and before active cooling, the temperature of the filaments is between $T_{spin}$−50° C. and $T_{spin}$+10° C.

* * * * *